United States Patent [19]

Leas

[11] 4,147,615

[45] Apr. 3, 1979

[54] HOT SAND-COAL-CRACKING TO HYDRODISTILLATE FUELS

[76] Inventor: Arnold M. Leas, 309 E. Van Buren, Columbia City, Ind. 46725

[21] Appl. No.: 786,927

[22] Filed: Apr. 12, 1977

[51] Int. Cl.[2] ..... C10G 1/04

[52] U.S. Cl. ..... 208/9; 75/29

[58] Field of Search ..... 208/8, 9, 10; 75/29, 75/40

[56] References Cited

U.S. PATENT DOCUMENTS

| | | | |
|---|---|---|---|
| 1,835,425 | 12/1931 | Pier | 208/10 |
| 1,890,439 | 12/1932 | Pier | 208/8 |
| 3,779,893 | 12/1973 | Leas et al. | 208/10 |
| 3,909,390 | 9/1975 | Urban | 208/10 |
| 4,007,108 | 2/1977 | Leas | 208/10 |

*Primary Examiner*—M. J. Andrews

*Attorney, Agent, or Firm*—Edward E. Dyson; John J. Byrne

[57] ABSTRACT

Fuel liquids and gases from a hydrocarbonaceous material such as coal may be produced by contacting the material with an iron group metal silicide, preferably cobalt and/or iron silicide. Also, an iron group metal silicate, preferably cobalt and/or iron silicate, provides a solid source of additional oxygen in the combustion of a carbonaceous fuel with oxygen. Carbon-coated sand, such as that produced in coal conversion utilizing an iron group metal silicide sand, is utilized in reduction of oxidic iron ores.

7 Claims, 4 Drawing Figures

HOT SAND-COAL-CRACKING TO HYDRODISTILLATE FUELS

BACKGROUND OF THE INVENTION

1. Field of the Invention

The present invention relates to a method of producing fuel liquids and gases from a hydrocarbonaceous material such as coal by contacting the material with an iron group metal silicide, preferably cobalt and/or iron silicide. The present invention also relates to a method of reducing an iron oxide-containing ore employing carbon-coated sand, typically a carbon-coated hot sand, coal-reaction effluent. Additionally, the present invention relates to a method of providing a solid source of additional oxygen in the combustion of a carbonaceous fuel with an oxygen-containing gas which comprises effecting said combustion in the presence of an iron group metal silicate, preferably cobalt and/or iron silicate.

2. Prior Art

The problems incurred in conversion of hydrocarbonaceous materials, such as coal, which contains coal macromolecular oxygen and sulfur bridges are well known (see U.S. Pat. Nos. 3,244,615 and 3,282,826). The prior art includes processes for producing fuel liquids and gases from hydrocarbonaceous materials at elevated temperatures, by utilizing catalysts and/or inert conveying materials and by propelling coal particles downwardly through vertically stacked zones in reactor towers of various configurations (see U.S. Pat. Nos. 3,617,464; 3,779,893 and 3,985,548). However, the prior art has not heretofor appreciated that an iron group metal silicide could be employed to advantage in the aforementioned conversion of hydrocarbonaceous materials such as coal to fuel liquids and gases.

In the prior art, inert sand particles have been used as a heat exchange medium (see U.S. Pat. No. 3,585,023), as a diluent (see U.S. Pat. No. 2,835,557) and as a catalyst support in the reduction of metallic oxides with a reducing gas (see U.S. Pat. No. 2,953,450). However, the art has not heretofor used carbon-coated sand particles in the reduction of iron-oxide or other equivalent metallic oxides or appreciated the advantages which are derived from such use.

BRIEF SUMMARY OF THE INVENTION

In accordance with the present invention, a method of producing fuel liquids and gases from a hydrocarbonaceous material is disclosed. The process comprises contacting said hydrocarbonaceous material with an iron group metal silicide at hydrocarbonaceous material conversion conditions. Preferably the hydrocarbonaceous material is coal. The preferred iron group metal silicides are cobalt silicide or iron silicide. Contact is preferably effected in the presence of an oxygen-containing gas, steam and, optionally, coal oil, which may comprise a recycled portion of the liquid fuel product. The contact is generally effected in a coal reactor, and the conversion conditions include a temperature of from about 800° F. to about 1800° F., a pressure of about 10 psig to about 3000 psig, and a silicide residence time of from about 5 to about 200 minutes.

A preferred embodiment of the invention constitutes an improved process for producing fuel liquids and gases from coal utilizing an oxygen-containing gas, steam, coal oils and a catalyst comprising cobalt silicide or iron silicide.

Another aspect of the present invention is a process for reducing a metallic oxide-containing ore. The process comprises mixing oxidic ore in particulate form with carbon-coated sand, contacting the ore particles and carbon-coated sand with an oxygen-containing gas at carbon monoxide formation conditions to form carbon monoxide, and reducing the metallic-oxide with the carbon monoxide. The carbon-coated particles may be obtained from coal reactors employing iron-group metal silicide particles for coal conversion or other similar carbonaceous material treatment systems. The process is preferably carried out utilizing a mixture of iron oxide particles and carbon-coated sand in the form of a fluidized bed. The carbon-coated sand is preferably in a preheated condition prior to mixture with the particulate iron ore and contact with the oxygen-containing gas, which may be air. Preferably steam is also present during reduction. It is desirable to follow reduction with carbon monoxide by reduction with hydrogen.

Another aspect of this invention includes a method of providing a solid source of additional oxygen in the combustion of a carbonaceous fuel with an oxygen-containing gas. The method comprises effecting the combustion in the presence of an iron group metal silicate preferably cobalt or iron silicate and most preferably iron silicate. Steam may be employed during combustion in order to moderate high temperatures occurring during combustion. Combustion may be effected in a multi-stage moving sand bed combustor arrangement. In the last stage of the multi-stage operation the iron group metal silicates which are transformed to silicides are oxidized back to silicates and recycled to the first stage. During this latter oxidation stage, substantial steam is utilized to moderate the high temperatures developed.

DETAILED DESCRIPTION OF THE INVENTION

Figure 1:
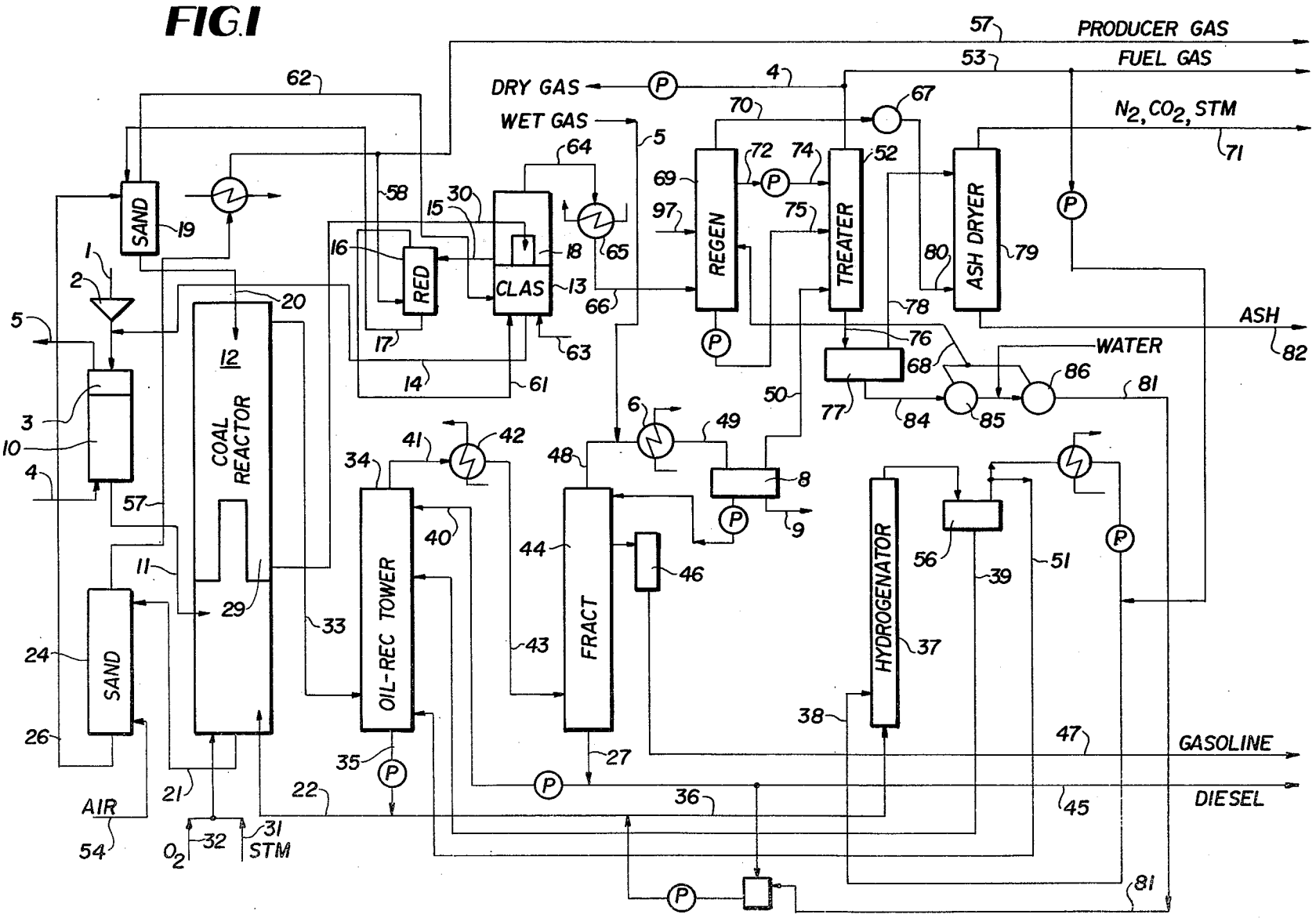
FIG. 1 is a schematic illustration of a coal-conversion process utilizing cobalt silicide to produce fuels as the primary product.

One aspect of the present invention finds application in the conversion of a variety of hydrocarbonaceous materials to fuel liquids and gases. The hydrocarbonaceous materials, alternatively called carbonaceous materials, which may be converted to fuel liquids and gases in accordance with this invention include coals, lignite, anthracite, bituminous coal and other solid carbonaceous materials including shales. Where coal is converted it may be crushed to particles of a size of ¼ inch or less; however, the use of larger particles is very suitable.

The hydrocarbonaceous conversion conditions include but are not limited to reduction and partial oxidation conditions wherein production of fuel gases are favored. Conversion is suitably effected at temperatures of from about 1000° F. to about 2000° F. Iron silicide is the preferred catalyst where vaporous fuels are desired as the primary product. Cobalt silicide is preferred where liquid fuels constitute the preferred product. The silicide particles are preferably of a size of ¼ inch or less; however, the use of larger particles is suitable. Generally the conversion conditions include elevated pressures within the range of from about 10 to about 3000 psig and elevated temperatures within the range of from about 800° F. to about 1800° F.

The reaction may be effected in any coal reactor arrangement especially arrangements providing for the recirculation of solid catalytic or inert sand particles. However, the reaction may suitably be effected in a reactor without any provision for external circulation. When the process is operated in this manner, vertical circulation of the iron group metal sand within the reactor occurs as a result of the density differential between the iron group metal silicides and the lighter iron group metal silicates formed within the reactor.

The silicides of this invention can be fed into coal reactors in like manner as conveying sands, and conversion or multizone coal reactor towers as described in U.S. Pat. No. 3,985,548 or U.S. Pat. No. 3,779,893 for the practice of this invention is readily accomplished.

The cobalt or iron silicide sand may be continuously withdrawn from a coal reactor and recirculated thereto, with a portion thereof withdrawn for regeneration of the cobalt or iron silicate which is formed during coal conversion to the silicide.

By utilizing hot circulating cobalt or iron silicide sand in contact with coal, coal oils, oxygen, and steam, high yields of distillate oils, hydrogen and higher BTU fuel gases are produced in a single coal reactor.

In the foregoing embodiment of the invention, the silicide sand is ciculated from near the top of a reactor to the bottom in a turbulent state. Coal is generally injected into the middle of the reactor and oxygen and steam may be injected into the bottom portion of the reactor. Either hydrogenated or non-hydrogenated recycle coal oil may also be introduced near the reactor bottom. Powdered ash is withdrawn from the bottom of a central annular area within the reactor and distillate fuels from the top of the reactor wherein steam is decomposed into hydrogen and oxygen.

Where cobalt silicide is employed in the present invention, hot dicobalt silicide recovers both hydrogen and oxygen from the steam and the product cobaltous orthosilicate is regenerated with carbon monoxide present in the reactor thereby repeating the cycle many times within the reactor as follows:

$$Co_2Si + 4\ H_2O \rightarrow 4\ H_2 + Co_2SiO_4$$

$$Co_2SiO_4 + 4\ CO \rightarrow 4\ CO_2 + Co_2Si$$

In addition the cobalt reagent recovers oxygen from the organic oxygenated coal oils as follows:

$$4\ ROH + Co_2Si \rightarrow 4\ RH + Co_2SiO_4$$

$$CO_2SiO_4 + 4\ CO \rightarrow 4\ CO_2 + Co_2Si$$

thereby substantially reducing the amount of purchased oxygen and hydrogen required to upgrade coal into the more marketable distillate fuels and hence the capital and operating costs in converting coal and other crude fossil fuels into distillate fuel oils and gases.

In a like manner, hot iron silicide recovers both hydrogen and oxygen from the steam and the product iron silicate is regenerated with carbon monoxide present in the reactor thereby repeating the cycle many times within the reactor as follows:

$$FeSi + 3\ H_2O \rightarrow 3H_2 + FeSiO_3$$

$$FeSiO_3 + 3CO \rightarrow 3CO_2 + FeSi$$

In addition the iron reagent also recovers oxygen from the organic oxygenated coal oils as follows:

$$3\ ROH + FeSi \rightarrow 3RH + FeSiO_3$$

$$FeSiO_3 + 3CO \rightarrow 3CO_2 + FeSi$$

The added advantage of coal conversion utilizing cobalt and iron silicides resides in the flexibility provided by varying the particular silicide employed, the conditions of coal conversion, the mode of silicide regeneration and coal product utilization.

Cobalt silicide is the more active catalyst. Where it is desired to produce distillate liquid fuels as the primary product, $Co_2Si$ is preferred as the circulating sand.

The ranges of operating conditions for liquid fuel production are as follows:

| | Preferred | General |
|---|---|---|
| Top zone Temperature ° F. | 800 to 900 | 500 to 1200 |
| Middle zone Temperature ° F. | 1200 to 1400 | 1000 to 1600 |
| Bottom zone Temperature ° F. | 1300 to 1600 | 1200 to 1800 |
| Reactor pressure, psig | 50 to 200 | 10 to 3000 |
| Sand residence time, minutes | 30 to 60 | 5 to 200 |

Where it is desired to produce fuels as the primary product, as would be the case where the fuels are to be oxidized in the presence of steam to drive a power wheel for the generation of electricity, iron silicide is preferred as the circulating sand.

The ranges of operating conditions for production of gaseous or vapor fuel products are as follows:

| | Preferred | General |
|---|---|---|
| Top zone Temperature ° F | 800 to 900 | 500 to 1200 |
| Middle zone Temperature ° F | 1200 to 1400 | 1000 to 1600 |
| Bottom zone Temperature ° F | 1300 to 1600 | 1200 to 1800 |
| Reactor pressure, psig | 400 to 600 | 100 to 3000 |
| Sand residence time, minutes | 30 to 60 | 5 to 200 |

Where it is desired to recover and utilize carbon-coated particles for the reduction of oxidic ores, gaseous fuel gases and concomitant high carbon formation is provided whereby the quantity of carbon deposition on the catalyst particles is enhanced.

The ranges of operating conditions for such operation are as follows:

| | Preferred | General |
|---|---|---|
| Top zone Temperature ° F. | 800 to 900 | 500 to 1200 |
| Middle zone Temperature ° F. | 1200 to 1400 | 1000 to 1600 |
| Bottom zone Temperature ° F. | 1300 to 1600 | 1200 to 1800 |
| Reactor pressure, psig | 30 to 300 | 10 to 3000 |
| Sand residence time, minutes | 30 to 60 | 5 to 200 |

Also, in accordance with this invention hydrogen sulfide formed during coal conversion may be used in the recovery of heavy metals and residual catalyst. By forming an alkaline-water solution from the powdered ash removed at the bottom of a coal reactor, and by using in-process hydrogen sulfide to treat the solution, iron, cobalt and other insoluble sulfides may be recovered.

Optionally, heavy distillate hydrogenated oil may be introduced near the bottom of the coal reactor where the hot fluidized silicide sand is circulating, whereby the heavy oil is cracked and vaporized into diesel oil, gasoline, and fuel gases.

Bench scale data with steam and oxygen injected at the reactor bottom and cobalt silicide sand being fed at a rate of 200 lbs/hr. was as follows:

| | |
|---|---|
| coal charge crushed ¼ inch | 100 lbs./hr. |
| diesel product | 34% of coal energy |
| gasoline product | 32% of coal energy |
| 900 BTU fuel gas | 8% of coal energy |
| products | 74% of coal energy |
| reactor pressure | 100 psig |
| reactor top temperature | 900° F. |
| sand bed temperature | 1500° F. |
| ash product | 10% of coal |

It was observed that hydrogen generation at the top of the reactor was very rapid. Oxygen was recovered from the coal and steam.

The catalyst particles of this invention as noted before are preferably less than ¼ inch in diameter. More preferably the catalyst particles are in the size range between 30 and 100 mesh. Generally and dependent on the type of coal or other carbonaceous material being treated as well as the product desired the ratio of coal to catalyst within the reactor may vary from about 0.5:1.0 to about 1:5 by weight; the ratio of oxygen to coal may vary from about 0.05:1 to about 0.5:1; and the ratio of steam to coal may vary from about 0.05:1 to about 0.5:1.

Where catalyst and coal are continuously being fed to the reaction zone, the ratio of the rate at which coal solids are fed to the reaction zone to the particulate catalyst in the reaction zone may be in the range between 0.5:1 to 1:5.

FIG. 1 is a schematic representation of an overall coal conversion process wherein cobalt silicide is utilized as the catalyst.

The raw coal may be pretreated by drying and crushing. Since the free moisture content of coal may vary from about 5% to 50%, this preliminary operation will vary. Conventional crushing to one-fourth inch or less and drying to about 20% moisture is satisfactory. The coal is fed from conveyor 1 to the coal lock-bin 3 via line 2. After coal is partially dried to a moisture content of about 10% with hot recycle gas from line 4, the water from the coal is recovered via line 5, line 48, condensor 6, line 49, accumulator 8 and line 9. This water may be recycled to regenerator 69. The coal is pressured to coal feeder 10, and then via line 11 to coal reactor 12. Coarse cobalt recycle is recovered in ash classifier 13, and fed via lines 14 and 2 into the coal lock-bin 3. Fine cobalt recycle is recovered from ash classifier 13 via line 15 to cobalt reducer 16, and is then passed via line 17 to sand feeder 19 and to the top of the reactor 12 via line 20. The hot cobalt silicide sand circulates from sand feeder 19, via line 20, through reactor 12. The sand is withdrawn from the reactor via line 21, and passed to sand lock-bin 24 and back to sand feeder 19. The ash is withdrawn from reactor annular space 29 via line 30 and is passed to ash classifier 13. Gasifying steam is introduced via line 31 and oxygen via line 32 into the bottom of reactor 12. The fuel gas, distillate oil vapors, and excess steam exit coal reactor 12 via line 33 to oil recycle tower 34. A portion of the condensed oil is recycled via lines 35 and 22 back to coal reactor 12. Another portion of the condensed oil is pumped via lines 35 and 36 to the high pressure hydrogenating tower 37. Hydrogenating tower effluent is passed via line 55 to separator 56. Recycle hydrogen is fed from line 38 to hydrogenator 37. Hydrogen is also recycled to oil recycle tower 34 via line 51. The hydrogenated products exit via line 39 to the top of the recycle tower 34. Diesel oil reflux via lines 27 and 40 cools the top of the recycle tower 34. The diesel, gasoline, fuel gas, and recycle hydrogen exit from tower 34 via line 41, exchanger 42, and line 43 to the fractionator 44. The diesel product exits via lines 27 and 45; gasoline exits via stripper 46 and line 47; the fuel gas, recycle gas, and steam exit via line 48, exchanger 6, and line 49, and are passed into accumulator 8. The fuel gas exits via line 50 to the treater 52 and then exits to product line 53.

In the embodiment concerning the removal of residual carbon from the circulating sand, illustrated in FIG. 1, air is fed from line 54 to the sand lock-bin 24. Produced gas exits via lines 57 and 58 to cobalt reducer 16. Residual producer gas exits the reducer 16 via line 61 to ash classifier 13. The sand lift gases (nitrogen and a small amount of air) exit the vent line 62 from sand feeder 19 and flow to ash classifier 13. Because the coarse and hot cobalt ($Co_3O_4$) burns residual gases, safety relief gases are introduced via line 63 into the bottom of ash classifier 13. The stack gases from classifier 13 exit via line 64, exchanger 65 and line 66 and flow to regenerator tower 69. These stack gases from the top of ash classifier 13 contain considerable nitrogen, carbon dioxide, powdered ash, cobalt dust, and residual steam. In regenerator 69, the carbon dioxide and nitrogen exit via line 70, gas turbine 67, line 80, ash drier 79 and line 71 and are vented to the atmosphere. Because the alkaline metals (potassium and sodium) from the ash are water soluble, they dissolve in the water introduced in the regenerator via line 68 and/or line 9, and the resulting regenerated sodium carbonate water is pumped from tower 69 via lines 72 and 74 into the top of treater tower 52. The aqueous solution removes particulate material from the stack gases. The ash-water slurry is pumped from the bottom of regenerator tower 69 via line 75 to the middle of treater tower 52. The fuel gas is pressured via line 50 to the treater 52. In the treater tower 52, the heavy metals (cobalt, iron, nickel) are precipitated out as sulfides. The ash slurry exits the treater bottom via line 76 to settling tank 77. The lighter lime slurry exits via line 78 to ash drier 79. In the ash drier some of the hot stack gases from regenerator 69 exit via line 70, gas turbine 67 and pass via line 80 to the bottom of ash drier 79 to remove the water from the ash slurry. The dried ash exits line 82 as a by-product; also the nitrogen and steam are vented via line 71 to the atmosphere. The heavy metal sulfides exit the bottom of settler 77 via line 84 and centrifuges 85 and 86. Water from centrifuges 85 and 86 is recycled to regenerator 69 via line 68. The water washed and dried metal sulfides are then recycled via line 81 and line 36 to hydrogenator tower 37.

With the circulating granular silicide sand, the recovery of the ash and cobalt powder is very good in the reactor annular space 29. With the recycle of coarse cobalt oxide from classifier 13, the recycle of the cobalt from the annular space 18 of the ash classifier 13, and the recovery of the precipitated cobalt sulfide from the ash-slurry 77 followed by double centrifuging of the cobalt sulfide in centrifuges 85 and 86 and recycle to the hydrogenator; the cobalt silicide reagent is retained in the system with negligible loss.

Another aspect of this invention relates to iron ore reduction, utilizing carbon-coated silicate particles withdrawn from a coal reactor. Carbon-coated particles withdrawn from the coal reactors utilizing iron group metal silicides are very suitable. These particles are mixed with iron ore, preferably of ¼ inch size or less and contacted counter-currently with a limited amount of air or oxygen and, preferably, also with steam, to form a carbon monoxide-containing reducing atmosphere. The carbon-monoxide operates to reduce iron oxide. Preferably, at least about 90% of the oxidic iron is reduced in this manner. Thereafter hot, dry hydrogen is injected counter-currently into the hot iron-sand mixture to essentially completely reduce the iron. The product is withdrawn through a controlled magnetic separator wherein purified iron is recovered, preferably in a pressure container that is hydrogen cooled. Pure reduced iron product is thus obtained. The sand and non-magnetic iron compounds inclusive of iron sulfates and iron sulfides are withdrawn from the magnetic separator free from carbon and suitable for recycle back to the reactor from which they were withdrawn.

Iron ore reduction is preferably effected utilizing a fluidized bed. During fluidization, a substantial portion of the gangue is separated and withdrawn from the sand. The chemical reactions are:

$$3\,Fe_2O_3 + 9CO \rightarrow 9CO_2 + 6Fe$$

$$Fe_2O_3 + 3\,H_2 \rightarrow 3\,H_2O + 2\,Fe$$

$$FeO + H_2S \rightarrow FeS + H_2O$$

$$C + H_2O \rightarrow H_2 + CO$$

$$C + \tfrac{1}{2}O_2\,(air) \rightarrow CO + N_2 + heat$$

The carbonated sand which is at a high temperature after withdrawal from the coal reactor provides a substantial amount of the heat, particularly during residual iron oxide reduction with hydrogen. During the fluidized bed reduction, the iron ore particles physically flex to discharge gangue to the sand stream. During the controlled magnetic separation phase, the small amount of impure iron present generally in the form of sulfides or sulfates is recovered with the sand. Therefore, the impure iron may then be recycled and re-refined to an eventual pure iron product.

In its broadest aspect the feature of the invention relates to reducing iron oxide contained in iron ore to metallic iron which comprises mixing the iron oxide ore in particulate form with carbon-coated sand, contacting the iron ore particles and carbon-coated sand with an oxygen-containing gas at carbon monoxide formation conditions to form carbon monoxide and reducing iron-oxide to metallic iron with the carbon monoxide.

The best results are obtained where the mixture of iron oxide particles and carbon-coated sand are in the form of a fluidized bed.

It is preferred that the carbon-coated sand is in a preheated condition prior to mixture with the particulate iron ore and contact with the oxygen-containing gas.

Air, oxygen, or other available oxygen-containing gas may be employed.

The carbon-coated particles preferably are in the size range 15 and 200 mesh, with oxidic iron ore particles falling within a like size range. The carbon-coating on the particles may comprise from about 5 to about 10 percent of the carbon-coated particle weight. Quantitative oxygen and carbon requirements based on the oxidic ore feed rate are determined in the conventional manner. Where steam is employed the ratio thereof to the amont of carbon is from about 0.05:1.0 to about 0.2:1.0 by weight.

Preferably, following the reduction of iron oxide with carbon monoxide, to effect about 90% iron oxide reduction, hydrogen is then employed to substantially complete the reduction. Hydrogen may be used to effect cooling and to avoid contact with an oxidizing environment.

The utilization of carbon-coated sand particles provides a number of advantages.

The locus of carbon-monoxide formation is at the sand-carbon interface therefore heat transfer from and to the sand for the purpose of initiating carbon oxidation and preventing localized overheating is facilitated.

In one preferred embodiment of this invention, where, the carbon-coated particles are derived from the processing of carbonaceous fuel sources at elevated temperatures, important added advantages are obtained. Because the more volatile and reactive components of the material from which the carbon coating is derived generally do not deposit upon the sand in the course of treatment of carbonaceous materials, the carbon coating is relatively contaminant free. Accordingly, the use of such carbon-coated inert particulate matter ameliorates the problem of contamination of reduced product by ash or sulfur which occurs with the use of coal, coke, or char as reducing agents.

Moreover, the carbon coating adheres to the sand surface and to this end carbon-iron or carbon-iron oxide agglomeration and/or mixture is ameliorated.

Finally, whereas carbonaceous deposits on sand are usually removed prior to recycle of the sand by oxidation of carbon to carbon dioxide, in this invention the highly exothermic oxidation of carbon monoxide to carbon dioxide with oxygen and the attendant thermal shock to sand particles is avoided. Schematically oxidation of carbon monoxide is accomplished as illustrated in the following well known equation:

$$3Fe_2O_3 + 9CO \rightarrow 9CO_2 + 6Fe$$

This reaction is endothermic. The high temperature and sometimes runaway temperatures attributable to afterburning (and occurring where carbon is removed by oxidation to carbon dioxide) are avoided.

During the reduction process steam may be introduced to prevent any substantial carbon redeposition and to produce hydrogen and carbon monoxide, the reducing agents employed in reduction of iron oxide.

This invention provides a method for both reducing oxidic iron ore and regenerating a carbon-coated sand effluent derived from a hydrocarbonaceous reaction by contacting the hydrocarbonaceous material, preferably coal, with sand particles in a reactor to form fuel liquids and or gases and carbon-coated sand, separating carbon-coated sand from the fuel liquids and/or gases, mixing carbon-coated sand separated from the fuel liquids and/or gases with oxidic iron ore in particulate form, contacting the oxidic iron ore particles and carbon-coated sand with an oxygen-containing gas at carbon monoxide forming conditions to form carbon monoxide to reduce iron oxide to metallic iron and separating the metallic iron from the sand particles. The sand particles separated from the metallic iron are suitably recycled to the reactor for reuse to form fuel liquids and/or gases. The sand particles may comprise iron group metal silicides, preferably iron silicide or cobalt silicide. Generally, the iron-oxide reduction is effected within a temperature range of from about 1000° F. to about 2000° F. It is preferred that reduction within situ formed carbon monoxide gas be effected at temperatures of from about 1300° F. to about 1700° F. and that hydrogen reduction be effected at a temperature of from about 1000° F. to 1300° F.

The iron-oxide containing ore, which is also referred to as oxidic iron ore, may be natural ore or ore concentrate in finely-divided form or iron oxides from other sources or mixtures thereof.

The term sand is used in its broadest sense inclusive of all silaceous solid particles and equivalents thereof.

Figures 2, 3:
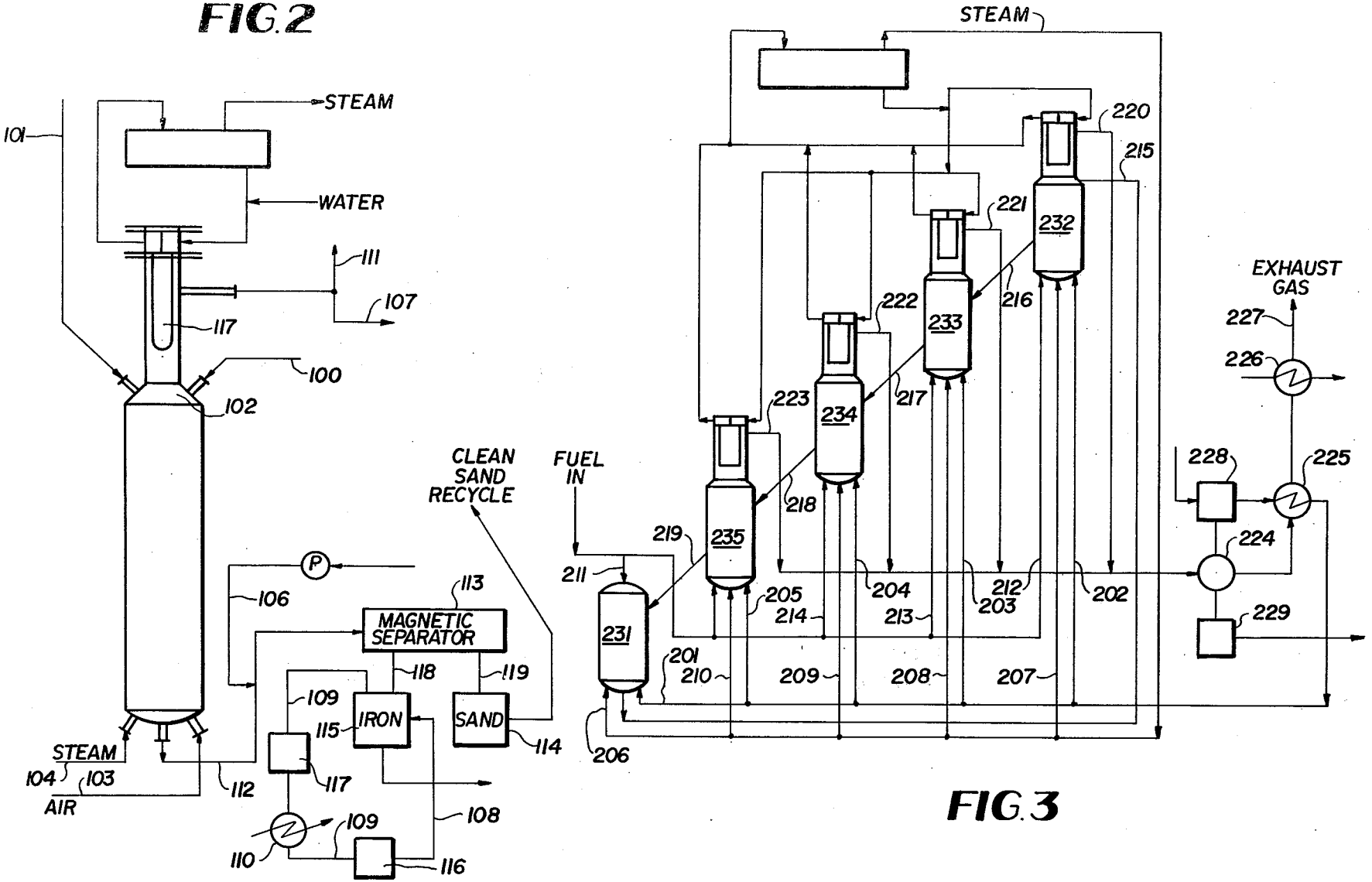
FIG. 2 illustrates schematically the arrangement wherein the carbon-coated sand withdrawn from the coal reactor is employed for reduction of an oxidic iron ore.
FIG. 3 illustrates schematically multistage combustion utilizing iron silicate as added source of oxygen.

FIG. 2 illustrates schematically the arrangement wherein carbon-coated sand is utilized for reduction of an oxidic iron ore. Carbon-coated sand, such as carbon-coated sand withdrawn from coal reactors utilizing iron group metal silicides is introduced via line 100 into the upper portion of sand lock bin 102. Suitable carbon-coated sand preferably of ¼ inch size or less is introduced into the upper portion of sand lock bin 102 via line 101 and mixed with the carbon-coated sand, preferably of ¼ inch size or less. As the lock-bin 102 is being filled, air via line 103 and steam via line 104 are injected into the bottom portion of lock-bin 102. Reduction is effected in lock-bin 102 utilizing carbon monoxide generated therein by reaction of air and steam with the carbonaceous coating on the sand. As the iron oxide is being reduced, the hot carbon dioxide, steam, nitrogen, and some unreacted carbon monoxide and hydrogen flow upward to steam generator system 117 and then flow out through 111.

Upon substantial completion of the reduction of the iron oxide with carbon monoxide, the introduction of air and steam is discontinued and hydrogen is introduced into duct 112 via line 106 countercurrently to the metallic iron which is transferred via duct 112 from the sand lock-bin to the magnetic separator 113. Metallic iron and sand are pressured to magnetic separator 113 wherein the reduced iron is recovered in pressure tank 115 via line 118 and sand and impure iron (iron sulfide or sulfate) are recovered in tank 114 via line 119. Hydrogen and/or steam formed by the further reduction of iron oxide with hydrogen is withdrawn through line 107. Hydrogen withdrawn from tank 115 is continuously circulated through a hydrogen loop via line 109 to cooler 117, drier 110, compresser 116 and then via line 108 back to tank 115, there is cool the metallic iron product.

Yet another aspect of this invention provides a solid source of additional oxygen in the combustion of a carbonaceous fuel with oxygen by effecting said combustion in the presence of an iron group metal silicate such as iron silicate. Steam is preferably also introduced into the combustion zone.

The catalyst particles of this invention as noted before are preferably less than ¼ inch in diameter. More preferably the catalyst particles are in the size range between 30 and 100 mesh. Generally and dependent on the type of fuel being combusted the ratio of fuel to catalyst within the combustor may vary from about 1:10 to about 1:30 by weight; and the ratio of steam to fuel being combusted may vary from about 1:0 to about 0.5:1.0. Oxygen is introduced into the combustor(s) to provide the stoichiometric amount required in the oxygen-fuel combustion reaction.

Where oxygen and steam are used to regenerate the silicide to silicate the molecular ratio of oxygen to silicide is preferably within the range of from about 1:1 to about 3:1 and the ratio of steam to oxygen is about 0.05:1 to about 2:1.

Combustion may suitably be effected in a single combustor. When the process is operated in this manner, vertical circulation of the iron group metal sand within the reactor occurs as a result of the density differential between the iron group metal silicates and the lighter iron group metal silicides formed within the reactor.

It is believed that the following reactions occur at the designated loci within a combustor of a carbonaceous fuel with oxygen:

| Density | | |
|---|---|---|
| 3.5 gm/cc | $FeSiO_3$ | $+ 3\ CO \rightarrow FeSi + 3CO_2$ combustor top |
| 3.5 gm/cc | $FeSiO_3$ | $+ 3\ H_2 \rightarrow FeSi + 3\ H_2O$ combustor top |
| 6.1 gm/cc | FeSi | $+ 1\frac{1}{2}\ O_2 \rightarrow FeSiO_3$ combustor bottom |
| 6.1 gm/cc | FeSi | $+ 3\ H_2O \rightarrow 3\ H_2 + FeSiO_3$ combustor bottom |

As is noted by reference to the foregoing reactions, iron silicate effects combustion of carbon monoxide and thereby furthers complete combustion and steam acts to regenerate iron silicide to the desired silicate and by this endothermic reaction to moderate operating temperatures.

In accordance with the invention combustion may also be effected in a combustion zone comprising a plurality of serially connected combustors with provision for regeneration of iron group metal silicide to iron group metal silicate. Carbonaceous fuel may be combusted by introducing the carbonaceous fuel, steam, iron group metal silicate sand and oxygen into a combustion zone, optionally comprising a series of combustors, at combustion conditions to form a first gaseous combustion product and iron group metal silicide. The gaseous combustion product and the iron group metal silicide are withdrawn from the combustion zone. The iron group metal silicide is reacted with steam to form iron group metal silicate which is then recycled to the combustion zone. The iron group metal silicide is preferably cobalt silicide or iron silicide and most preferably iron silicide. The combustion product gas may be used as motive fluid for a turbine power plant. The combustion product gas may be passed in heat exchange relationship with water to generate steam prior to use of the combustion product gas in a turbine power plant. Steam generated in the foregoing manner may be used as reactant steam for transforming the iron group metal silicide to silicate and/or as steam introduced into the combustion zone. Steam generated by contact in heat exchange relationship with the combustion product gas may also be introduced directly into the combustion product gas prior to use of the combustion product gas in a turbine power plant.

The use of iron group metal silicate allows for substantially complete combustion of fuel to be effected utilizing about stoichiometric quantities of oxygen. Therefore, the combustion gases passed into the turbine power plant do not contain detrimental quantities of excess oxygen.

With specific reference to FIG. 3, air is distributed through lines 201, 202, 203, 204 and 205 to combustor stages 231 through 235 respectively. Steam is distributed through lines 206, 207, 208, 209 and 210 to combustor stages 231 through 235 respectively. Fuel is distributed through lines 211, 212, 213 and 214 to combustor stages 231 through 234 respectively.

The sand is circulated through each of the combustor stages via lines 215 through 219 respectively. The exhaust gas pressures out past each steam generator via lines 220 through 223 to the gas turbine 224, to air exchanger 225, heat recovery exchanger 226 and then to the atmosphere via line 227. The gas turbine 224 drives air compressor 228 and electric generator 229.

For large power plant applications, FIG. 3 illustrates a circulating iron silicate reagent within the five stage combustor. Particularly in large power plants for coal power to mechanical drivers, the circulating metallic reagent is desirable to insure rapid oxidation and reduction and direct contant heat exchange in the fluidized sand bed. The presence of iron silicate serves to maintain an excess of oxygen as iron silicate. The final or fifth stage combustor does not require fuel. The heat of oxidation is very substantial and requires most of the cooling steam as shown below, where a typical feed distribution is set forth:

| Stage no. | Air % | Fuel % | Steam % |
|---|---|---|---|
| 1 | 15 | 25 | 12 |
| 2 | 15 | 25 | 12 |
| 3 | 15 | 25 | 12 |
| 4 | 15 | 25 | 12 |
| 5 | 40 | 0 | 52 |
| | 100 | 100 | 100 |

The oxygen content of the metallic circulating reagent is gradually consumed within the first four stages and the reagent fully reoxidized with air within the final or fifth stage combustor to maintain an excess of oxygen throughout the total unit. Since oxygen is stored as a solid, virtually no free oxygen exits to the gas turbine. The large amount of cooling steam maintains the peak combustion temperatures below 2000° F. to virtually avoid nitrogen oxide emissions. Overhead steam generators may be employed to lower the combustion gases to about 1500° F. to protect the rotor within the power wheel. While most of the sand is kept in a fluidized state in the bottom portion of combustors 232, 233, 234 and 235 a portion of the sand spills over into a peripheral annular space within the combustors to build a more dense solid level to drive the sand into the next lower combustor chamber. Within the first stage combustor, the sand is also fluidized to burn the fuel but it is pressured from the combustor chamber through the riser duct to the top of combustor 232 to continuously recycle the sand flow. As the exhaust gases are cooled in the upper steam generator the gas velocity is reduced. The sand gravity flow is controlled by the pressure differential and the sand levels are maintained well below the steam generator tubes.

This invention also provides a method for combusting a gaseous or liquid fuel formed by the conversion of a hydrocarbonaceous material in the presence of an iron group metal silicide catalyst which comprises contacting hydrocarbonaceous material with iron group metal silicide catalyst which comprises contacting hydrocarbonaceous material with iron group metal silicide catalyst in a reactor to form gaseous fuel and an iron group metal silicate, combusting the gaseous fuel with an oxygen-containing gas and iron group metal silicate formed in the hydrocarbonaceous material reactor to form a combustion gas and iron group metal silicide and recycling iron group metal silicide to the hydrocarbonaceous material reactor. The iron group metal silicide may be iron silicide or cobalt silicide and the hydrocarbonaceous material may be coal.

Figure 4:
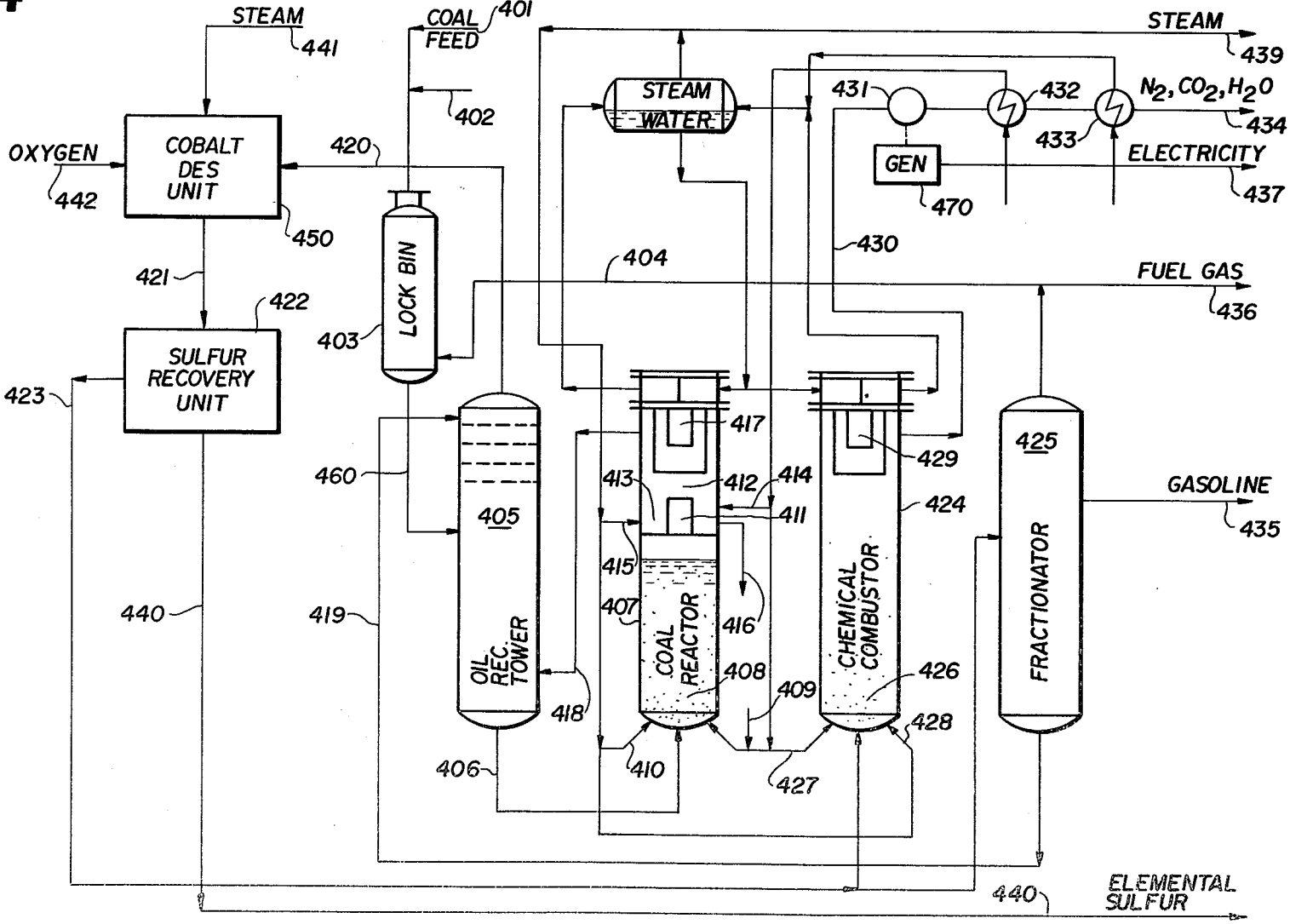
FIG. 4 illustrates schematically a coal-conversion process using iron silicide to produce fuels which are combusted to produce electrical energy.

FIG. 4 illustrates schematically a coal-conversion process using iron group metal silicide to produce fuels which are then combusted in the presence of iron silicate to produce electrical energy. In this embodiment of the invention coal conversion is effected in a coal reactor containing a fluidized bed of iron group metal silicide catalyst, optionally with iron oxide also present, wherein the catalyst is not recirculated externally of the coal reactor.

Coal which is suitable for this and the preceding embodiments of the invention includes any form of solid carbonaceous substance suitable for catalytic conversion, for example bituminous, semibituminous, subbituminous grades of coals including lignites, kerogen, peats, semianthracite, and the like.

Use of a fluidized catalyst bed of particulate iron silicides and iron silicates in the bottom zones of a coal reactor and fuel combustor respectively provides a facile process for converting coal to electricity and/or fuel gases and liquids.

In this embodiment of the invention the catalyst of the fluidized bed is not recirculated externally of the coal reactor; therefore, in order to maintain a clean plant, a detergent may be introduced into the coal reactor. The detergent contains a sand of lesser density than the silicate of the iron group metal silicide which comprises the fluidized catalyst bed of the coal reactor. The detergent may also contain clay and other neutralizing agents. The quantity of detergent employed is based on the amount of coal processed and may be from about one percent to about ten percent by weight of the coal.

Referring to FIG. 4, coal is fed through conveyor 401 and detergent is fed through conveyor 402 into coal lock-bin 403. Recycle fuel gas from line 404 pressures the coal and detergent into oil recycle tower 405 via line 460. Within oil recycle tower 405, oil is extracted from the coal and the combined coal-oil-detergent slurry is pumped from the bottom of oil recycle tower 405 through line 406 to the bottom of coal reactor 407. In the bottom zone of the coal reactor, iron silicides 408 are fluidized by incoming oxygen 409 and steam 410 to crack the incoming coal and oil in the coal-oil-detergent slurry. Ash and detergent are driven by the fluidizing gases upward through central duct 411 into enlarged volume 412. The ash and detergent settle downward in annular area 413 wherein incoming air via line 414, and steam via line 415, remove carbon from the ash. The ash and detergent are pressured to ash storage via line 416. A conventional steam generator 417 located at the top of coal reactor 407 cools overhead fuel gases and oil vapor prior to pressuring of the overhead vapor and gas to oil recycle tower 405 via line 418. Diesel oil from line 419 refluxes the top of oil recycle tower 405, and clean oil vapors and fuel gases exit at the top of the tower 405 via line 420 into conventional cobalt desulfurizer unit 450. Desulfurized fuel gases and oil are passed from desulfurizer unit 450 to a conventional sulfur recovery unit 422 and exit via line 423. One portion of the fuel gases and oil vapor in line 423 is passed into combustor 424 for combustion therein and another portion of the fuel gases and oil vapor is passed into fractionator 425. Within the bottom zone of the chemical combustor iron silicates 426 are used to effect substantially complete combustion of the fuel with air introduced through line 427. Steam is fed via line 428 into combustor 424 to control combustor temperature. At the top of combustor 424, a conventional steam generator 429 cools the combusted gases which then flow via line 430 to gas turbine 431. The waste heat is then recovered from the combusted gases in air preheater 432 and water heater 433 before the combusted gases exit to the environment denoted by the numeral 434.

In fractionator 425, gasoline, line 435, and fuel gas, line 436, are withdrawn as products. Electricity 437 is produced by gas turbine 431 and generator 470. Excess or product steam leaves through line 439. Elemental sulfur, line 440, is produced as a by-product of intermittent regeneration of cobalt desulfurization catalyst within the cobalt desulfurization unit. Steam 441 and trace amounts of oxygen 442 are used for regeneration.

In the above described process, illustrated by FIG. 4, extracted and/or cracked oil from the coal is used to slurry and to transport the coal feed into the bottom of the coal reactor for rapid cracking, gasification, and ash removal. Use of a conventional steam generator arrangement at the top of the coal reactor cools the fuel gas, oil vapors, and excess steam prior to introduction thereof into the oil recycle tower. Ash and detergent are blown out of the fluidized bed through a central duct in the reactor and then allowed to settle into the annular ash accumulator for decarbonizing and pressuring out to storage tanks. Because there is a substantial difference in the densities of iron silicide and iron silicate there is a rapid refluxing of recycle of these iron compounds to a locus within the bed wherein they are most effective.

Accordingly, the embodiment of the invention illustrated in FIG. 4, provides a simplified and inexpensive method for generation of electrical energy from coal which comprises forming fuel liquids and gases from coal in a first fluidized bed of iron group metal silicide, withdrawing the fuel liquids and gases from the first fluidized bed, combusting at least a portion of the fuel liquids and gases from the first fluidized bed with an oxygen-containing gas in a second fluidized bed of iron group metal silicate to form a combustion product gas, withdrawing the combustion product gas from the second fluidized bed and using said combustion product gas as motive fluid for a turbine power plant. Moreover, detergent comprising a sand having a density less than the silicate of the iron group metal silicide In the first fluidized bed is continuously passed upwardly through said first fluidized bed to maintain a clean plant.

Utilization of an inert detergent sand of density and size such that it will be passed upwardly and out of the fluidized bed, prevents plugging of the bed due to gummy material formation. Preferably the cleansing sand is about two thirds the weight of the iron group metal silicide/silicate catalyst. Along with the detergent sand, clay suitably in the form of fines such as a silica-aluminate clay may be passed through the fluidized bed to remove alkaline earth metals such as sodium. The clay particles are passed through the fluidized bed and removed as is the detergent sand with the ash.

Additionally, while there have generally been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. A method of producing fuel liquids and gases from a solid hydrocarbonaceous material which comprises contacting said hydrocarbonaceous material with an iron group metal silicide in the presence of an oxygen-containing gas and steam, at hydrocarbonaceous material conversion conditions to form iron group metal silicate and a fuel liquid and gas product.

2. The method of claim 1, wherein said hydrocarbonaceous material is coal.

3. The method of claim 2, wherein said iron group metal silicide is cobalt silicide or iron silicide.

4. The method of claim 3 wherein said contact is effected in the presence of a coal oil.

5. The method of claim 4 wherein the conversion conditions include a temperature of from about 1000° F. to about 2000° F., and the coal is in the form of particles about one quarter inch or less in size.

6. The method of claim 2 wherein said hydrocarbonaceous material is coal, the conversion conditions include a temperature of from about 800° F. to about 1800° F., a pressure of from about 10 to about 3000 psig, and a silicide residence time of from about 5 to about 200 minutes, and the iron group metal silicide is cobalt silicide or iron silicide.

7. The method of claim 1 further characterized in that iron group metal silicate formed by contact with the hydrocarbonaceous material, oxygen-containing gas and steam is:

(a) separated from fuel liquid and gas product;

(b) reduced to form iron group metal silicide; and, returned into contact with said hydrocarbonaceous material, oxygen-containing gas and steam.

* * * * *